US006062765A

United States Patent [19]

Dotson

[11] Patent Number: 6,062,765

[45] Date of Patent: May 16, 2000

[54] VEHICLE ARRESTING SYSTEM

[75] Inventor: John Arthur Dotson, Eugene, Oreg.

[73] Assignee: John A. Dotson, Eugene, Oreg.

[21] Appl. No.: 09/193,103

[22] Filed: Nov. 16, 1998

Related U.S. Application Data

[60] Provisional application No. 60/065,444, Nov. 24, 1997.

[51] Int. Cl.[7] ..... E01F 13/12; E01F 15/06

[52] U.S. Cl. ..... 404/6; 49/9; 49/34; 49/131; 188/371; 188/376

[58] Field of Search ..... 49/9, 33, 34, 49, 49/131; 244/110 C; 256/13.1; 404/6, 11; 188/371, 376

[56] References Cited

U.S. PATENT DOCUMENTS

| | | | |
|---|---|---|---|
| 1,692,142 | 11/1928 | Strauss . | |
| 4,576,507 | 3/1986 | Terio | 404/6 |
| 4,818,137 | 4/1989 | Gorlov | 404/6 |
| 4,824,282 | 4/1989 | Waldecker | 404/6 |
| 5,624,203 | 4/1997 | Jackson et al. | 404/6 |
| 5,762,443 | 6/1998 | Gelfand et al. | 404/6 |
| 5,823,705 | 10/1998 | Jackson et al. . | |

*Primary Examiner*—James A. Lisehora

[57] ABSTRACT

The present invention to provides a rapidly deployable system and method for arresting the movement of a vehicle with minimal injury to the vehicle or its occupants. The invention provides a system which applies a braking force which varies according to vehicle weight and speed by utilizing a series of frangible rods for dissipating the energy.

17 Claims, 7 Drawing Sheets

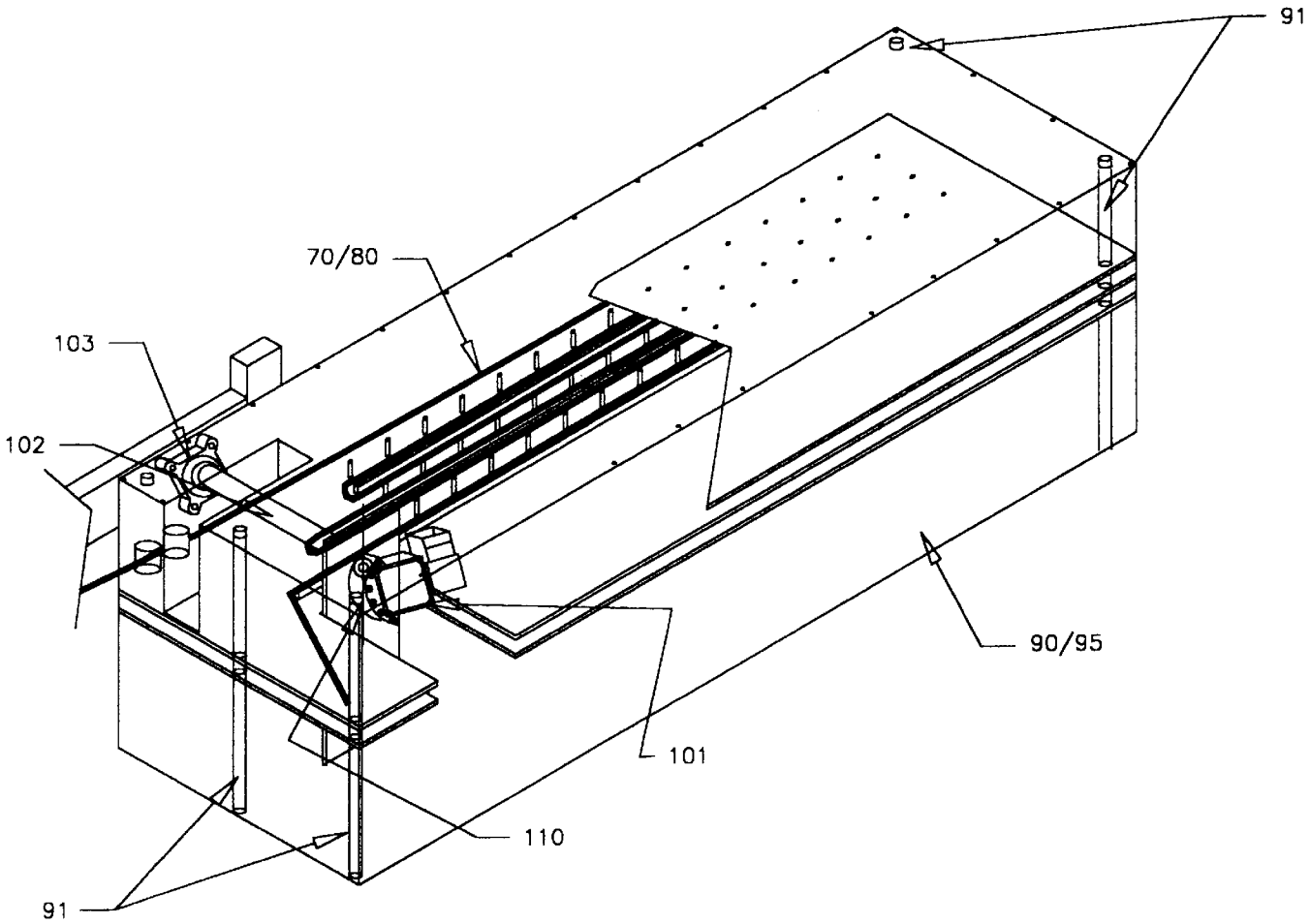
FIG 1–A

VEHICLE ARRESTING SYSTEM

This application claims the benefit of U.S. Provisional Application No. 60/065,444, filed Nov. 24, 1997.

FIELD OF THE INVENTION

The present invention relates to a rapidly deployable system and method for arresting the movement of a vehicle.

BACKGROUND OF THE INVENTION

Various systems for arresting a vehicle are well known in the art and have been employed for many uses such as control of railroad grade crossings and police and construction roadway barriers. Such systems range from relatively rigid (i.e. fixed) physical barriers such as guard rails to relatively mobile (i.e. flexible) barriers such as beams or nets disposed across the roadway. Barriers proposed in Terio, U.S. Pat No. 4,576,507 and Waldecker, U.S. Pat No 4,824, 282 illustrate systems configured to be disposed below-ground and rapidly raised as needed. Such systems employ various deceleration means such as deflation bags and nets connected to shock absorbing pistons. A vehicle striking the barrier will first impact the inflated bags and thereafter the net will be pushed forward in opposition to a yielding resistance of the shock absorbing pistons. Such systems are disadvantageous in they apply the same braking force regardless of vehicle weight or speed. The result is that a lighter vehicle is brought to an abrupt stop which may result in injury to the vehicle and its occupants.

With respect to prior art vehicle arresting systems, these systems are also disadvantageous in that they utilize components which are likely to degrade over time and make the system unreliable and costly to maintain. When stored under a roadway for long periods of time, deflation bags are susceptible to developing leaks. Likewise, energy dissipating pistons are typically either hydraulic in nature and require regular maintenance to insure proper fluid levels or employ springs which lose strength over time. Thus, a need exists for a suitable system for arresting vehicles with minimal injury to the vehicle or its occupants which requires little maintenance.

SUMMARY OF THE INVENTION

Accordingly, one or more of the following objects may be achieved by the present invention. It is an object of the present invention to provide a system and method for arresting the movement of a vehicle.

It is another object of the present invention to provide such a system that is configured to arrest such a vehicle with minimal injury to the vehicle or its occupants.

It is another object of the present invention to provide a system which applies a braking force which varies according to vehicle weight and speed.

It is another object of the present invention to provide such a system that is configured to be rapidly deployable.

It is another object of the present invention to provide such a system that utilizes materials that will not readily degrade due to exposure to normal weather conditions.

These and related objects of the present invention may be achieved by use of a vehicle arresting system as disclosed herein. The attainment of the advantages and features of the present invention should be more readily apparent to those skilled in the art, after review of the following detailed description of the invention taken together with the drawings.

BRIEF DESCRIPTION OF THE DRAWINGS

FIGS. 1 and 1A are a perspective view of a vehicle arresting system in a deployed position in accordance with the present invention.

DETAILED DESCRIPTION

Figure 1:
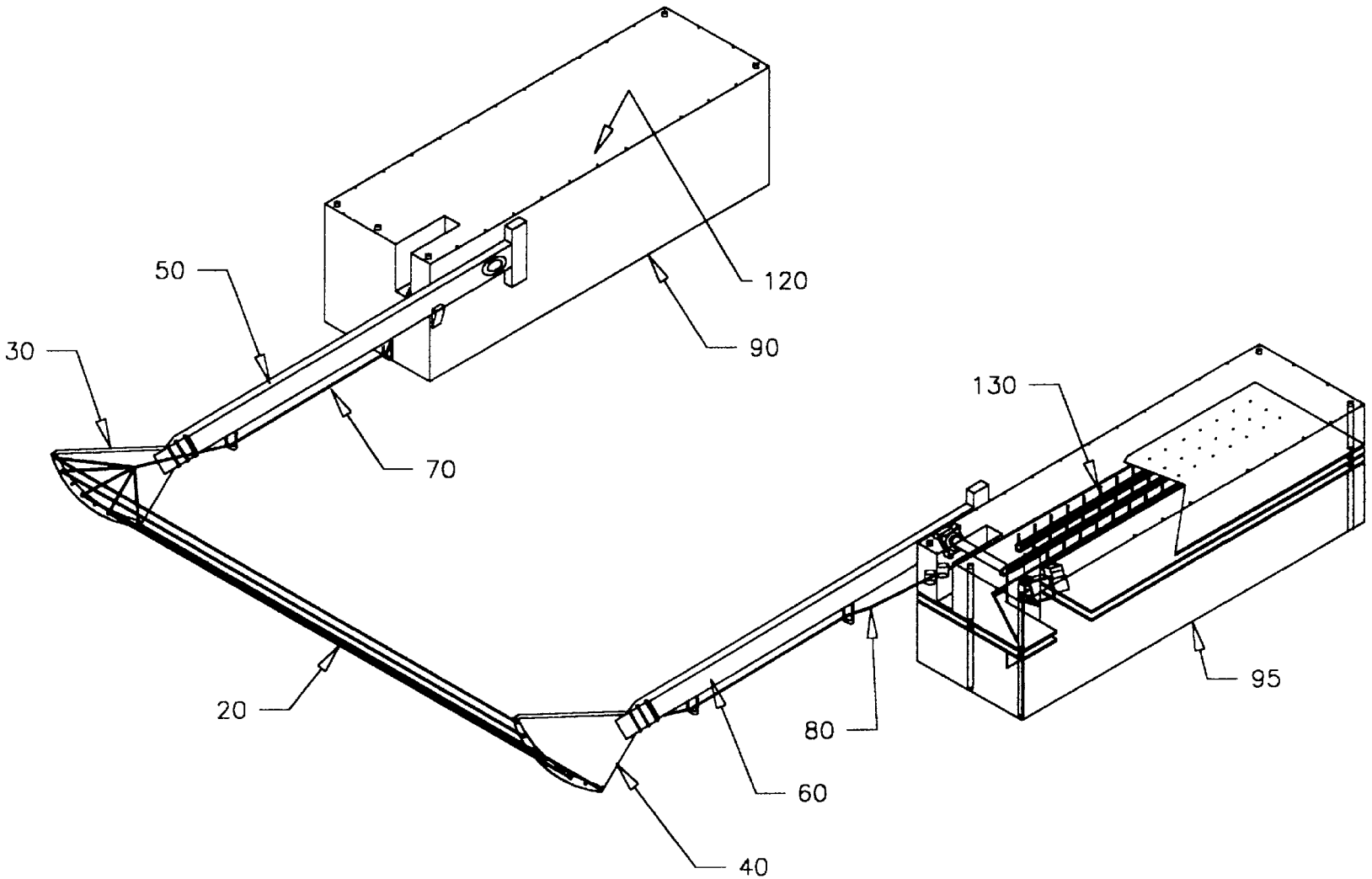

Referring to FIG. 1 and FIG. 1A a perspective view of a vehicle arresting system 10 in a deployed position in accordance with the present invention are shown. Arresting system 10 preferably includes capture net 20, rakes 30,40, rake arms 50,60, cables 70,80, housings 90,95, rake arm raising means 100, 110 and energy dissipaters 120,130. Housings 90,95 are fixed on either side of a roadway intended to be blocked with net 20 disposed across the path and held upright by rakes 30,40. Cables 70,80 connect net 20 to housings 90,95 and transfer energy exerted upon net 20 to energy dissipaters 120,130. As used herein, "roadway" is intended to include, but not be limited to, any sort of path or right of way intended to and customarily used by motor vehicle traffic, as well as airplane runways, and railways.

Net 20 is preferably a mesh and can be formed of any suitable material with a high tensile strength. A preferred material for net 20 is stainless steel cable which is woven to be contiguous with cables 70,80 through means well known in the art. Net 20 may alternatively be constructed of other natural or synthetic materials such as Kevlar, plastics or rubber and connected to cables 70,80 through means well known in the art. Also contemplated is a net designed to break when the energy dissipaters of the arresting means described herein becomes completely engaged by a vehicle.

Rakes 30,40 are connected to rake arms 50,60 and are configured to receive and hold net 20 in a vertical position relative to the road surface. Preferably rakes 30,40 are further configured to release net 20 when net 20 is engaged by a vehicle. Alternatively rakes 30,40 may be configured to break away from rake arms 50,60 and travel with net 20 when net 20 is engaged by a vehicle.

Rake arms 50,60 normally reside in a vertical position with net 20 extending across the roadway above the level of traffic, though utilizing a subterranean storage chamber is contemplated. Rake arms 50,60 are raised and lowered by arm raising means 100,110 and are connected to housing 90,95 respectively, thereby. Rake arms 50,60 preferably include weighted ends 52,62 to assist in rapid deployment of the system and are preferably provided with a plurality of cable supports 51,61 configured to break away as necessary when net 20 is engaged by a vehicle.

Arm raising means 100,110 is preferably a motor 101,111 mounted within housing 90,95 which raises and lowers rake arm 50,60 respectively through rotation shaft 102,112. Rotation shaft 102,112 is supported by a flange bearing 103,113 as shown. Alternatively, arm raising means 100,110 may be a counterweight system, hydraulic, pneumatic or explosive in nature as is well known in the art. Arm raising means

100,110 may be actuated by a sensing device, not depicted, capable of detecting the presence of an oncoming vehicle, e.g. an approaching train, or may be actuated by a manual switch operated by a visual observer.

Housing 90,95 is preferably anchored to the ground with a plurality of rods 91,96. Housing 90,95 is preferably substantially water tight and may be constructed of any material having sufficient tensile strength to support the internal components of the energy dissipaters as will be described in detail below. Housing 90,95 is preferably constructed of stainless steel though the use of other corrosion resistant materials is contemplated.

Figure 2:
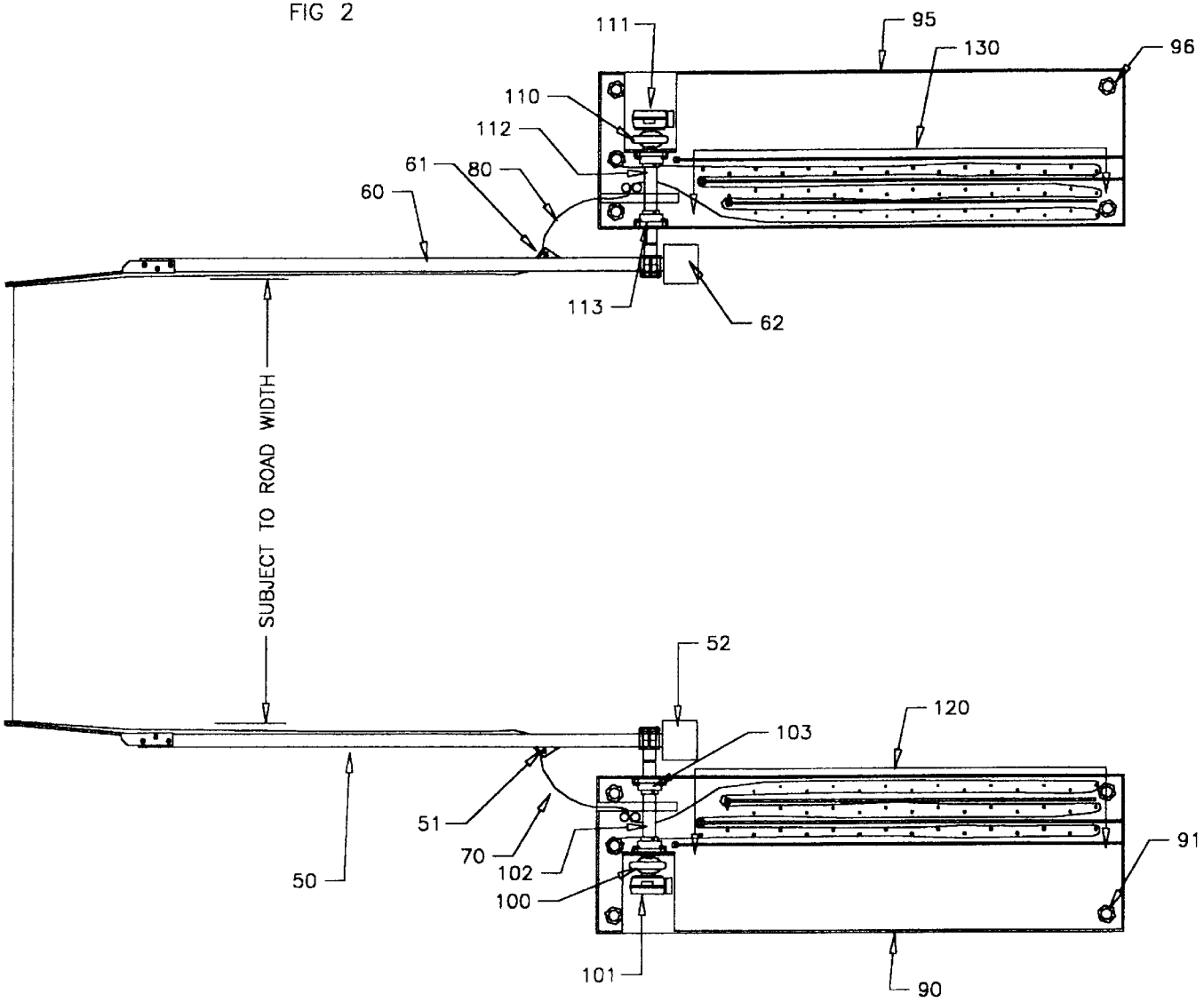
FIG. 2 is a plan view of the vehicle arresting system of FIG. 1 in accordance with the present invention.
Figure 3:
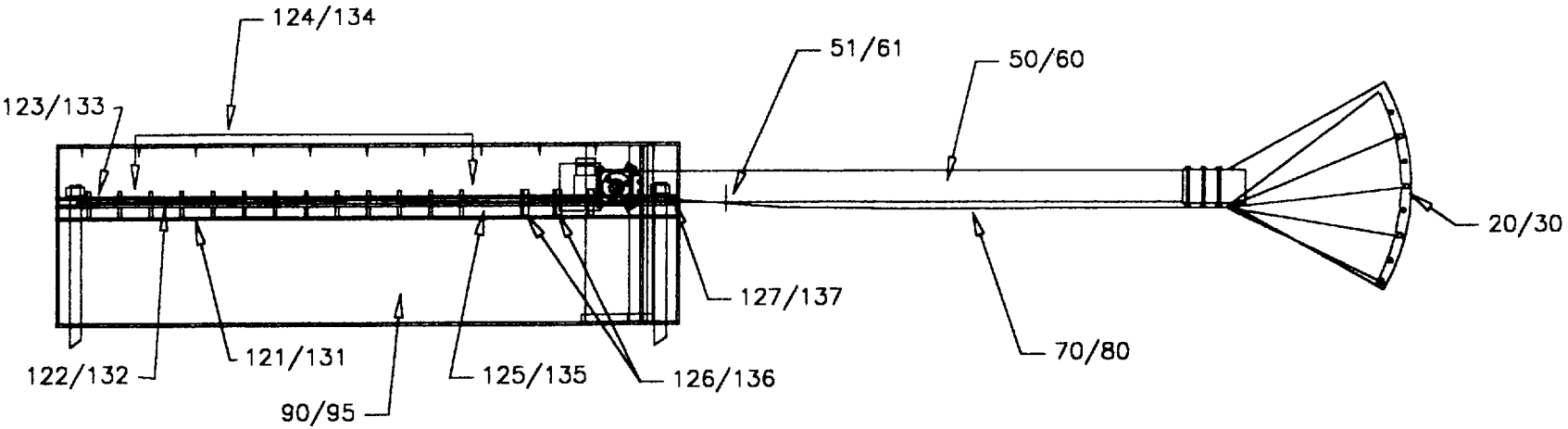
FIG. 3 is a side view of the vehicle arresting system of FIG. 1 in accordance with the present invention.

Referring to FIGS. 2 and 3, plan and side views of a vehicle arresting system 10 in accordance with the present invention are shown. Energy dissipater 120,130 preferably includes base plate 121,131, bottom centering plate 122,132, top centering plate 123,133, a plurality of frangible or collapsible rods 124,134, guide walls 125,135, guide rollers 126,136 and cable guide 127,137.

Base plate 121,131, bottom centering plate 122,132 and top centering plate 123,133 are preferably fixed within housing 90,95 in a parallel arrangement relative to each other, with both horizontal and vertical configurations relative to the road surface being contemplated. Bottom centering plate 122,132 is provided with a plurality of centering holes 128,138 arranged in rows which are in axial alignment with corresponding centering holes 129,139 provided in top centering plate 123,133. Frangible rods 124,134 are configured to be received through the holes of the respective centering plates and rest upon base plate 121,131. Guide walls 125,135 are provided between bottom centering plate 122,132 and top centering plate 123,133 and are preferably arranged to form a series of parallel lanes within which rows of frangible rods 124,134 are located.

Cable 70,80 extends from net 20 along rake arm 50,60 through cable supports 51,61 and cable guide 127,137 and into housing 90,95. Cable 70,80 is positioned between top centering plate 123,133 and bottom centering plate 122,132 within the parallel lanes formed by guide walls 125,135 to form an S-shape as shown. Guide rollers 126,136 relieve tension on cable 70,80 created by bending cable 70,80 around guide wall 125,135. Cable guide 127,137 insures cable 70,80 is dispensed without contacting housing 90,100 during operation. Cable guide 127,137 is preferably constructed of aluminum. The end of cable 70,80 is firmly connected to housing 90,95.

Figure 4:
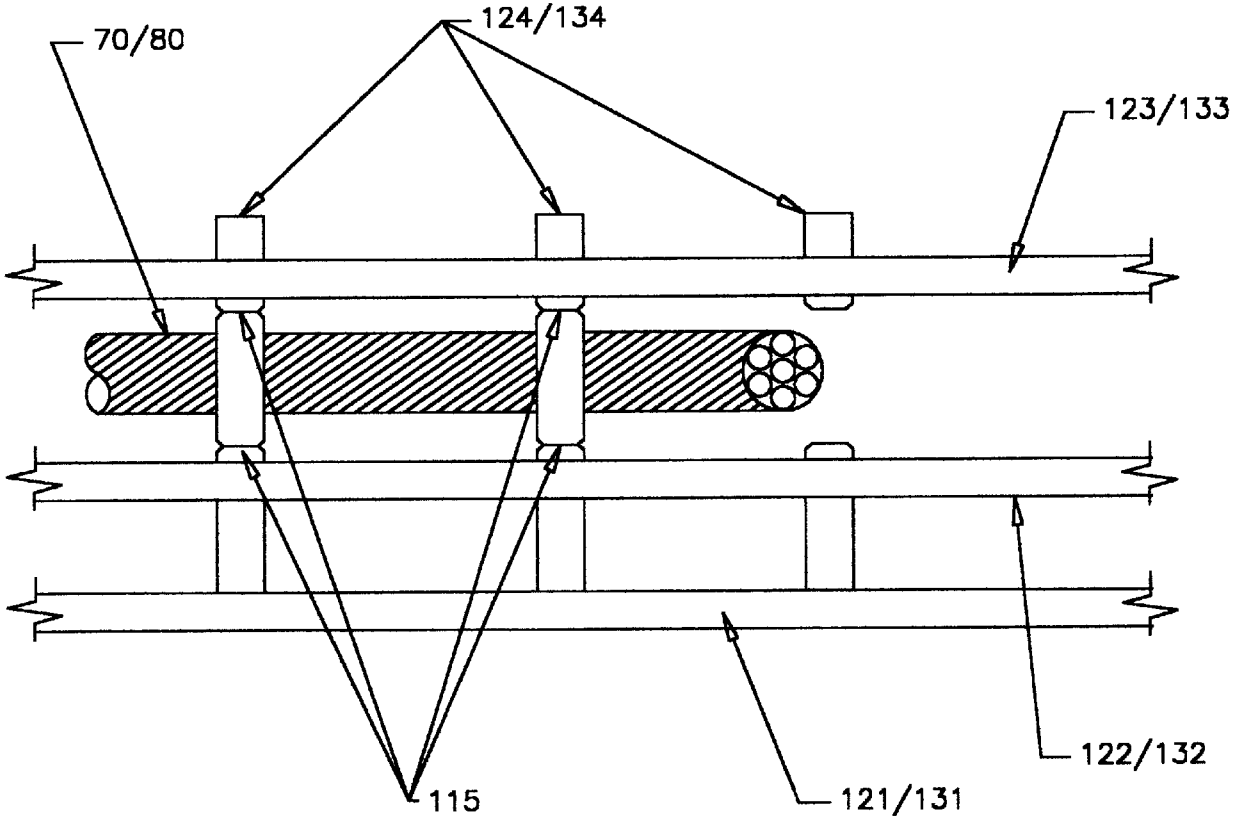
FIG. 4 is a side detail view of a portion of an energy dissipater of FIG. 1 in accordance with the present invention.

Referring to FIG. 4, a side detail view of a portion of energy dissipater 120,130 of FIG. 1 in accordance with the present invention is shown. In operation, when net 20, not depicted, is engaged by a vehicle, cable 70,80 engages frangible rods 124,134 and breaks, (i.e. shears into two pieces) each rod in sequence. Alternatively, one of the centering plates may be removed to leave the bottom end of each rod 124,134 unrestrained which allows each rod to be collapsed in sequence rather than broken. The vehicle's momentum is thereby transferred into the mechanical energy required to break or collapse the rods and hence the vehicle is brought to a stop. Frangible rods 124,134 are engineered and positioned so that only the number of rods necessary to counter the momentum of the vehicle will be broken or collapsed, as described in greater detail herein. A used herein, Applicant intends the term "collapse" to refer to the bending, crushing or otherwise deforming of a frangible rod without breaking the frangible rod into two or more pieces. Referring further to FIG. 4 a detail view of a frangible rod in accordance with the present invention is shown. Frangible rods 124,134 are engineered to break or collapse when a predetermined amount of shearing force is applied by cable 70,80, preferably by providing each rod with a plurality of scores 115 or other weakening points of a defined depth or magnitude. Cable 70,80 is designed to require a greater shearing force than the strongest frangible rod 124,134 in order to be broken. Frangible rods 124,134 are preferably round in cross section though the use of rods of any other shape in cross section including square, triangular and elliptical solids as well as shapes hollow in cross section, among others, are contemplated. Frangible rods 124,134 are preferably made of a corrosion resistant metal such as stainless steel or aluminum though the use of ceramics, plastics, carbon fiber, metal alloys, and fiberglass among others is contemplated.

Figure 5:
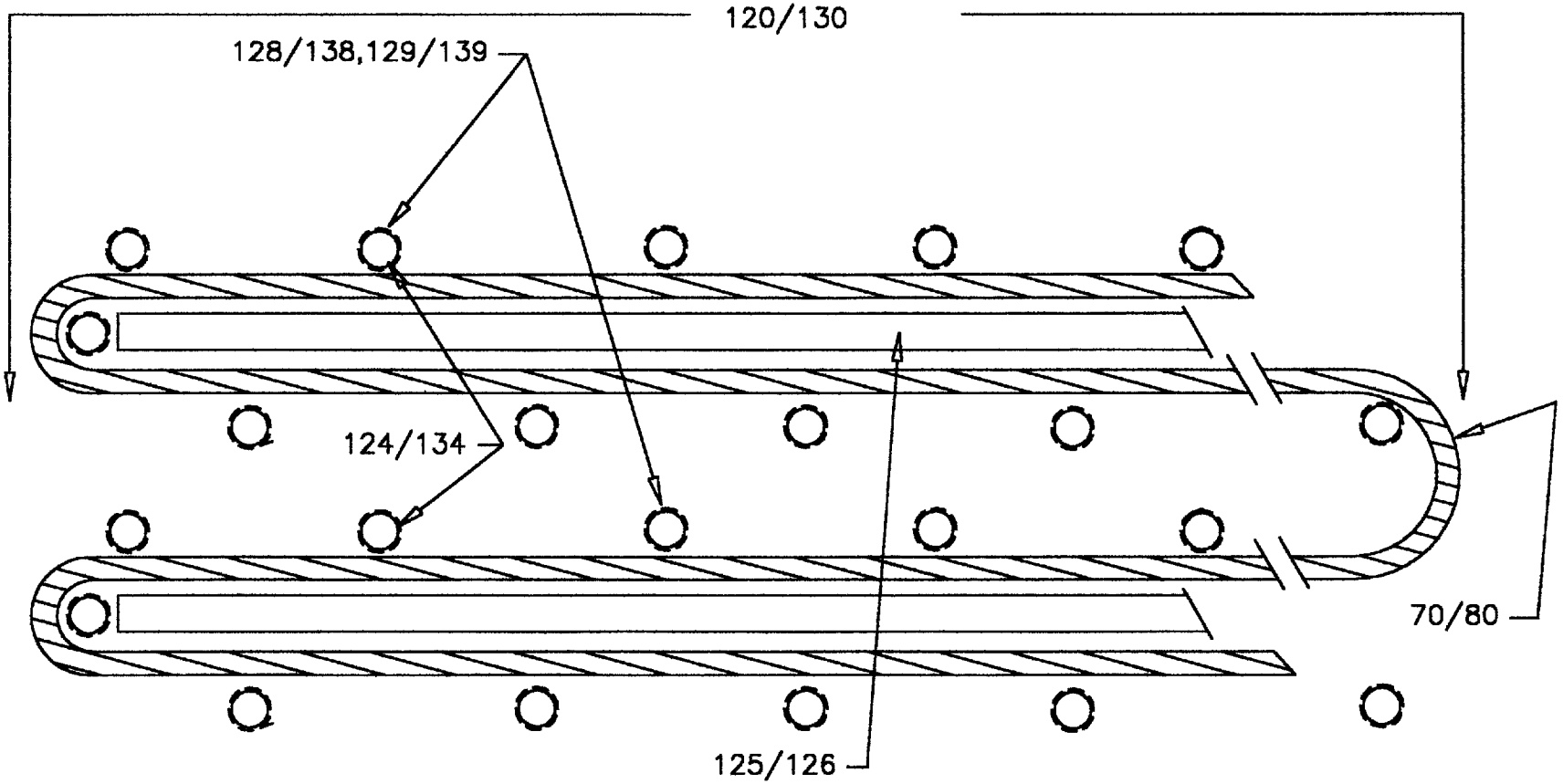
FIG. 5 is a plan view of a portion of an energy dissipater of FIG. 1 in accordance with the present invention.

Referring to FIG. 5 a plan view of a portion of energy dissipater 120,130 of FIG. 1 in accordance with the present invention is shown. Centering holes 128,138,129,139 are preferably configured to form staggered rows though straight rows are contemplated. Centering holes are preferably spaced six inches on center from each closest neighbor in a given lane and are preferably offset one-half inch from a center line opposite the offset of each nearest neighbor to form a one inch stagger as shown. The above described stagger is preferred because it allows the cable to remain in contact with all rods 124,134 at all times which smooths the transition from rod to rod during sequential breaking and therefore reduces stress on cable 70,80.

Referring to FIGS. 2 through 5 generally, energy dissipaters 120,130 preferably contain a plurality of guide walls 125,126 to define three rows of frangible rods 124,134, though any number of rows is contemplated. In a preferred three row configuration, Row 1 preferably contains 14 frangible rods 124,134 which are preferably ⅜ inch diameter aluminum rods engineered as follows. Each rod is preferably scored, cut, or otherwise weakened as set out in Table A wherein the horizontal axis of Table A represents the rod number and the vertical axis represents the row number. The numeral in each box represents the score depth on the designated rod as a percentage of rod diameter.

TABLE A

| Rod/ Row | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | .50 | .50 | .32 | .32 | .32 | .32 | .25 | .25 | .25 | .25 | .10 | .10 | .10 | .10 | |
| 2 | .17 | .22 | .22 | .22 | .22 | 0.0 | .24 | .24 | .24 | .15 | .15 | .15 | .15 | .15 | .15 |
| 3 | .05 | .05 | .05 | 0.0 | 0.0 | 0.0 | 0.0 | 0.0 | 0.0 | 0.0 | 0.0 | 0.0 | 0.0 | 0.0 | 0.0 |

Row 2 preferably contains 15 frangible rods 124,134 and are preferably ½ inch diameter aluminum rods preferably having score depths as set out in Table A. Row 3 preferably contains 15 frangible rods 124,134 and are preferably ⅝ inch diameter aluminum rods preferably having score depths as set out in Table A, though any combination of rod size, material and score depth is contemplated.

If a vehicle weighing 8000 lbs. engages a preferred system containing frangible rods as set out in Table A above at a speed of 30 mph, thereby producing 240,000 pounds of force at the time of contact, the vehicle will be brought to a halt in about 32 feet. This impact will engage and break the first 33 frangible rods in the system while leaving the remaining rods intact. If a vehicle weighing 4000 pounds were to hit a system identical to that described above at 30 mph, that vehicle would be brought to a stop in 23 feet and would engage and break only 15 rods. In each case it is assumed that the vehicle operator engages neither the brake nor the accelerator after the point of contact.

Figure 6:
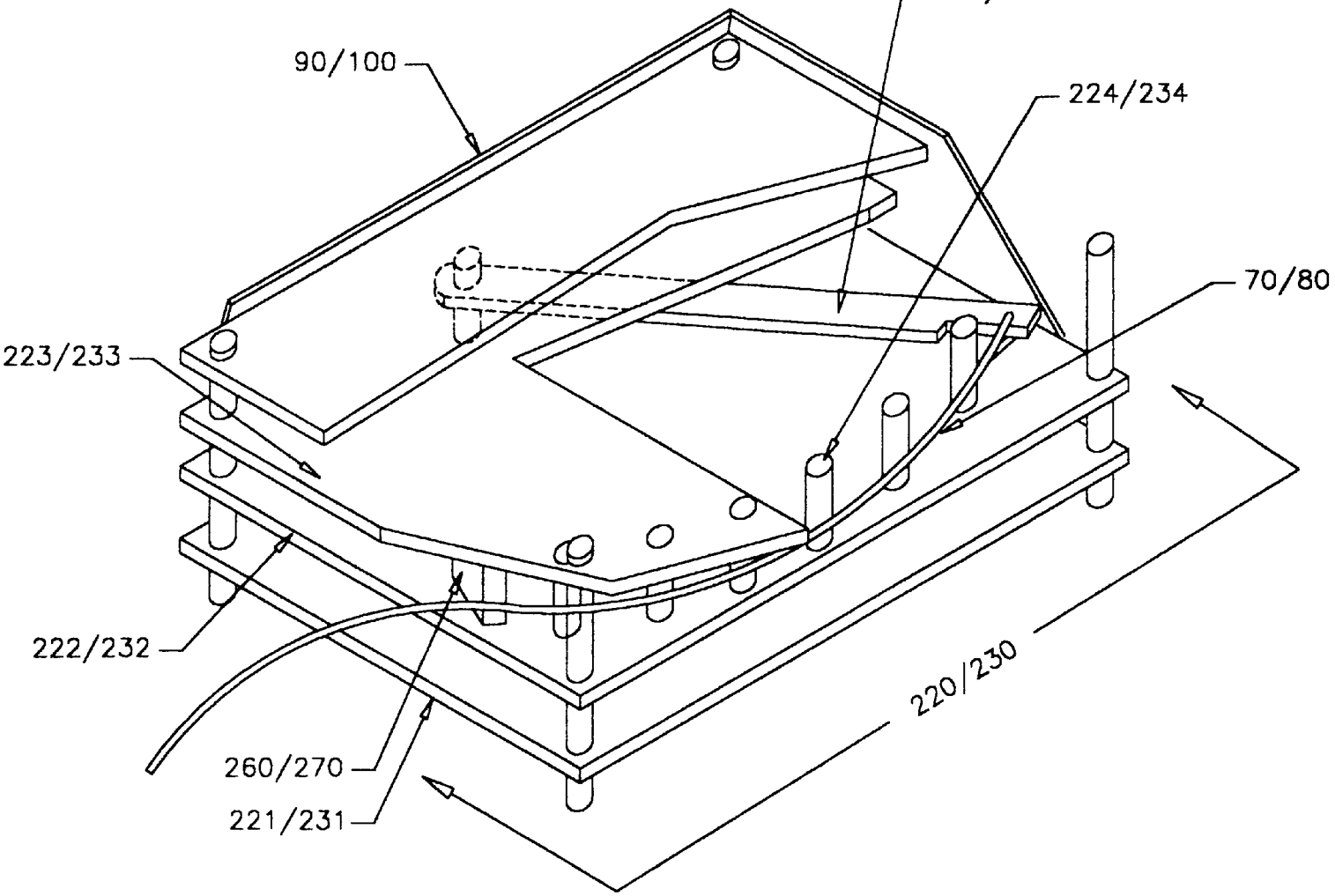
FIG. 6 is a plan view of an alternative embodiment of an energy dissipater in accordance with the present invention.

Referring to FIG. 6 an alternative embodiment of an energy dissipater in accordance with the present invention is shown. In the embodiment of FIG. 6, energy dissipater 220,230 preferably includes base plate 221,231, bottom centering plate 222,232, top centering plate 223,233, a plurality of frangible rods 224,234, transfer arm 240,250 and stop block 260,270. Base plate 221,231, bottom centering plate 222,232 and top centering plate 223,233 are arranged within housing 90,100 in a manner similar to that described above. Transfer arm 240,250 is pivotally connected to bottom centering plate 221, 231 so that it may pivot along an arc (a) in a plane between bottom centering plate 222,232 and top centering plate 223,233. The end of transfer arm 240,250 opposite the pivot point is connected to cable 70,80. Frangible rods 224,234 are inserted through corresponding holes in top and bottom centering plates as described above and arranged to impede the pivot path (a) defined by transfer arm 240,250. In operation, when net 20 is engaged by a vehicle, cable 70,80 tightens and causes transfer arm 240, 250 pivot along its defined path (a). Transfer arm 240,250 contacts and breaks frangible rods 224,234 in sequence to dissipate the momentum of the vehicle. If all frangible rods 224,234 in path (a) are engaged and broken the further progress of transfer arm 245,250 is stopped by stop block 260,270.

It is readily apparent that by varying factors such as metallurgy, score depth and rod shape among others the system can be tailored to stop a variety of vehicles in a variety of distances. While the invention has been described in connection with specific embodiments thereof, it will be understood that it is capable of further modification, and this application is intended to cover any variation, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. An apparatus for arresting the movement of a vehicle comprising:

(a) a capture net;

(b) a plurality of cables connected to said net on one end and connected to a housing on another end;

(c) an energy dissipating means disposed within said housing comprising a plurality of frangible rods which are engaged when said net is struck by a vehicle, wherein said frangible rods are broken or collapsed through said engagement, thereby dissipating the energy of said vehicle.

2. The apparatus of claim 1, wherein said frangible rods are engaged by said plurality of cables.

3. The apparatus of claim 1, wherein said capture net is comprised of a material selected from the group consisting of: (a) stainless steel cable woven to be contiguous with said plurality of cables, (b) plastic, and (c) rubber.

4. The apparatus of claim 1, wherein said capture net is releasably held in an upright position relative to a road surface by a plurality of net receiving rakes.

5. The apparatus of claim 1, wherein said frangible rods are comprised of a material selected from the group consisting of metal, plastic, fiberglass, carbon fiber, and ceramic.

6. The apparatus of claim 5, wherein said metal is selected from the group consisting of aluminum, stainless steel, and a corrosion resistant metal alloy.

7. The apparatus of claim 1, wherein said frangible rods are solid and have a shape in cross section selected from the group consisting of round, square, rectangular, triangular, oval, and elliptical.

8. The apparatus of claim 1, wherein said frangible rods are hollow and have a shape in cross section selected from the group consisting of round, square, rectangular, triangular, oval, and elliptical.

9. The apparatus of claim 1, wherein said capture net is located entirely above a road surface in its non-use position and is lowered to its use position to arrest the movement of a vehicle by a lowering and raising means.

10. The apparatus of claim 9, wherein said raising and lowering and raising means is actuated by a sensing means capable of sensing the presence of an approaching vehicle.

11. The apparatus of claim 9, wherein said lowering and raising means is actuated by a manual switch operated by a visual observer.

12. The apparatus of claim 1, wherein said capture net is located entirely below a road surface in its non-use position and is raised to its use position to arrest the movement of a vehicle by a raising means.

13. The apparatus of claim 12, wherein said raising means is actuated by a sensing means capable of sensing the presence of an approaching vehicle.

14. The apparatus of claim 12, wherein said raising means is actuated by a manual switch operated by a visual observer.

15. A method of stopping a vehicle comprising the steps of:

(a) disposing a capture net connected to an energy dissipating means through a plurality of cables across a roadway to be blocked;

(b) causing said energy dissipating means to impose a resisting force on said net through the breaking or collapsing of a plurality of frangible rods which are engaged when said net is struck by a vehicle, wherein said frangible rods are collapsed through said engagement, thereby dissipating the energy of said vehicle and bringing it to a stop.

16. The method of claim 15, wherein said capture net is located entirely above a road surface in its non-use position and is lowered to its use position to arrest the movement of a vehicle by a lowering and raising means.

17. The method of claim 15, wherein said capture net is located entirely below a road surface in its non-use position and is raised to its use position to arrest the movement of a vehicle by a raising means.

* * * * *